US011678417B2

(12) United States Patent
Yang et al.

(10) Patent No.: US 11,678,417 B2
(45) Date of Patent: Jun. 13, 2023

(54) SYSTEMS AND METHODS WITH TRIAC DIMMERS FOR VOLTAGE CONVERSION RELATED TO LIGHT EMITTING DIODES

(71) Applicant: ON-BRIGHT ELECTRONICS (SHANGHAI) CO., LTD., Shanghai (CN)

(72) Inventors: Jiqing Yang, Shanghai (CN); Zhuoyan Li, Shanghai (CN); Liqiang Zhu, Shanghai (CN); Jun Zhou, Shanghai (CN)

(73) Assignee: On-Bright Electronics (Shanghai) Co., Ltd., Shanghai (CN)

( * ) Notice: Subject to any disclaimer, the term of this patent is extended or adjusted under 35 U.S.C. 154(b) by 0 days.

(21) Appl. No.: 17/528,153

(22) Filed: Nov. 16, 2021

(65) Prior Publication Data

US 2022/0225483 A1 Jul. 14, 2022

Related U.S. Application Data

(63) Continuation of application No. 16/791,329, filed on Feb. 14, 2020, now Pat. No. 11,224,105.

(30) Foreign Application Priority Data

Feb. 19, 2019 (CN) ..... 201910124049.0

(51) Int. Cl.
*H05B 47/10* (2020.01)
*H05B 45/37* (2020.01)

(52) U.S. Cl.
CPC ..... *H05B 45/37* (2020.01)

(58) Field of Classification Search
None
See application file for complete search history.

(56) References Cited

U.S. PATENT DOCUMENTS 3,803,452 A 4/1974 Goldschmied
3,899,713 A 8/1975 Barkan et al.
(Continued)

FOREIGN PATENT DOCUMENTS

CN 1448005 A 10/2003
CN 101040570 A 9/2007
(Continued)

OTHER PUBLICATIONS

United States Patent and Trademark Office, Notice of Allowance dated Jul. 7, 2022, in U.S. Appl. No. 17/023,615.
(Continued)

*Primary Examiner* — Dedei K Hammond
(74) *Attorney, Agent, or Firm* — Faegre Drinker Biddle & Reath

(57) ABSTRACT

System and method for voltage conversion to drive one or more light emitting diodes with at least a TRIAC dimmer. For example, the system includes: a phase detector configured to receive a first rectified voltage generated based at least in part on an AC input voltage processed by at least the TRIAC dimmer, the phase detector being further configured to generate a digital signal representing phase information associated with the first rectified voltage; a voltage generator configured to receive the digital signal and generate a DC voltage based at least in part on the digital signal; and a driver configured to receive the DC voltage and affect, based at least in part on the DC voltage, a current flowing through the one or more light emitting diodes; wherein the current changes with the phase information according to a predetermined function.

20 Claims, 8 Drawing Sheets

(56) References Cited

U.S. PATENT DOCUMENTS 4,253,045 A 2/1981 Weber
5,144,205 A 9/1992 Motto et al.
5,249,298 A 9/1993 Bolan et al.
5,504,398 A 4/1996 Rothenbuhler
5,949,197 A 9/1999 Kastner
6,196,208 B1 3/2001 Masters
6,218,788 B1 4/2001 Chen et al.
6,229,271 B1 5/2001 Liu
6,278,245 B1 8/2001 Li et al.
7,038,399 B2 5/2006 Lys et al.
7,649,327 B2 1/2010 Peng
7,759,881 B1 7/2010 Melanson
7,825,715 B1 11/2010 Greenberg
7,880,400 B2 2/2011 Zhou et al.
7,944,153 B2 5/2011 Greenfeld
8,018,171 B1 9/2011 Melanson et al.
8,098,021 B2 1/2012 Wang et al.
8,129,976 B2 3/2012 Blakeley
8,134,302 B2 3/2012 Yang et al.
8,278,832 B2 10/2012 Hung et al.
8,373,313 B2 2/2013 Garcia et al.
8,378,583 B2 2/2013 Hying et al.
8,378,588 B2 2/2013 Kuo et al.
8,378,589 B2 2/2013 Kuo et al.
8,415,901 B2 4/2013 Recker et al.
8,432,438 B2 4/2013 Ryan et al.
8,497,637 B2 7/2013 Liu
8,558,477 B2 10/2013 Bordin et al.
8,569,956 B2 10/2013 Shteynberg et al.
8,644,041 B2 2/2014 Pansier
8,653,750 B2 2/2014 Deurenberg et al.
8,686,668 B2 4/2014 Grotkowski et al.
8,698,419 B2 4/2014 Yan et al.
8,716,882 B2 5/2014 Pettler et al.
8,742,674 B2 6/2014 Shteynberg et al.
8,829,819 B1 9/2014 Angeles et al.
8,890,440 B2 11/2014 Yan et al.
8,896,288 B2 11/2014 Choi et al.
8,941,323 B1 1/2015 Wu et al.
8,941,324 B2 1/2015 Zhou et al.
8,941,328 B2 1/2015 Wu et al.
8,947,010 B2 2/2015 Barrow et al.
9,030,122 B2 5/2015 Yan et al.
9,084,316 B2 7/2015 Melanson et al.
9,131,581 B1 9/2015 Hsia et al.
9,148,050 B2 9/2015 Chiang
9,167,638 B2 10/2015 Le
9,173,258 B2 10/2015 Ekbote
9,207,265 B1 12/2015 Grisamore et al.
9,220,133 B2 12/2015 Salvestrini et al.
9,220,136 B2 12/2015 Zhang et al.
9,247,623 B2 1/2016 Recker et al.
9,247,625 B2 1/2016 Recker et al.
9,301,349 B2 3/2016 Zhu et al.
9,332,609 B1 5/2016 Rhodes et al.
9,402,293 B2 7/2016 Vaughan et al.
9,408,269 B2 8/2016 Zhu et al.
9,414,455 B2 8/2016 Zhou et al.
9,467,137 B2 10/2016 Eum et al.
9,480,118 B2 10/2016 Liao et al.
9,485,833 B2 11/2016 Datta et al.
9,554,432 B2 1/2017 Zhu et al.
9,572,224 B2 2/2017 Gaknoki et al.
9,585,222 B2 2/2017 Zhu et al.
9,655,188 B1 5/2017 Lewis et al.
9,661,702 B2 5/2017 Mednik et al.
9,723,676 B2 8/2017 Ganick et al.
9,750,107 B2 8/2017 Zhu et al.
9,781,786 B2 10/2017 Ho et al.
9,820,344 B1 11/2017 Papanicolaou
9,883,561 B1 1/2018 Liang et al.
9,883,562 B2 1/2018 Zhu et al.
9,961,734 B2 5/2018 Zhu et al.
10,054,271 B2 8/2018 Xiong et al.
10,153,684 B2 12/2018 Liu et al.
10,194,500 B2 1/2019 Zhu et al.
10,264,642 B2 4/2019 Liang et al.
10,292,217 B2 5/2019 Zhu et al.
10,299,328 B2 5/2019 Fu et al.
10,334,677 B2 6/2019 Zhu et al.
10,342,087 B2 7/2019 Zhu et al.
10,362,643 B2 7/2019 Kim et al.
10,375,785 B2 8/2019 Li et al.
10,383,187 B2 8/2019 Liao et al.
10,405,392 B1 9/2019 Shi et al.
10,447,171 B2 10/2019 Newman et al.
10,448,469 B2 10/2019 Zhu et al.
10,448,470 B2 10/2019 Zhu et al.
10,455,657 B2 10/2019 Zhu et al.
10,499,467 B2 12/2019 Wang
10,512,131 B2 12/2019 Zhu et al.
10,530,268 B2 1/2020 Newman et al.
10,568,185 B1 2/2020 Ostrovsky et al.
10,616,975 B2 4/2020 Gotou et al.
10,687,397 B2 6/2020 Zhu et al.
10,785,837 B2 9/2020 Li et al.
10,827,588 B2 11/2020 Zhu et al.
10,973,095 B2 4/2021 Zhu et al.
10,999,903 B2 5/2021 Li et al.
10,999,904 B2 5/2021 Zhu et al.
11,026,304 B2 6/2021 Li et al.
11,183,996 B2 11/2021 Zhu et al.
11,201,612 B2 12/2021 Zhu et al.
11,206,015 B2 12/2021 Zhu et al.
11,212,885 B2 12/2021 Liao et al.
11,224,105 B2 1/2022 Yang et al.
11,252,799 B2 2/2022 Li et al.
11,297,704 B2 4/2022 Zhu et al.
11,405,992 B2 8/2022 Li et al.
2006/0022648 A1 2/2006 Ben-Yaakov et al.
2007/0182338 A1 8/2007 Shteynberg et al.
2007/0182699 A1 8/2007 Ha et al.
2007/0267978 A1 11/2007 Shteynberg et al.
2008/0224629 A1 9/2008 Melanson
2008/0224633 A1* 9/2008 Melanson ..... H05B 45/14 315/292
2008/0278092 A1 11/2008 Lys et al.
2009/0021469 A1 1/2009 Yeo et al.
2009/0085494 A1 4/2009 Summerland
2009/0251059 A1 10/2009 Veltman
2010/0141153 A1 6/2010 Recker et al.
2010/0148691 A1 6/2010 Kuo et al.
2010/0156319 A1 6/2010 Melanson
2010/0164406 A1 7/2010 Kost et al.
2010/0176733 A1 7/2010 King
2010/0207536 A1 8/2010 Burdalski et al.
2010/0213859 A1 8/2010 Shteynberg et al.
2010/0219766 A1 9/2010 Kuo et al.
2010/0231136 A1 9/2010 Reisenauer et al.
2011/0012530 A1 1/2011 Zheng et al.
2011/0037399 A1 2/2011 Hung et al.
2011/0074302 A1 3/2011 Draper et al.
2011/0080110 A1 4/2011 Nuhfer et al.
2011/0080111 A1 4/2011 Nuhfer et al.
2011/0080112 A1 4/2011 Shearer et al.
2011/0101867 A1 5/2011 Wang et al.
2011/0121744 A1 5/2011 Salvestrini et al.
2011/0121754 A1 5/2011 Shteynberg et al.
2011/0133662 A1 6/2011 Yan et al.
2011/0140620 A1 6/2011 Lin et al.
2011/0140621 A1 6/2011 Yi et al.
2011/0187283 A1 8/2011 Wang et al.
2011/0227490 A1 9/2011 Huynh
2011/0260619 A1 10/2011 Sadwick et al.
2011/0285301 A1 11/2011 Kuang et al.
2011/0291583 A1 12/2011 Shen
2011/0309759 A1 12/2011 Shteynberg et al.
2012/0001548 A1 1/2012 Recker et al.
2012/0032604 A1 2/2012 Hontele
2012/0056553 A1 3/2012 Koolen et al.
2012/0069616 A1 3/2012 Kitamura et al.
2012/0080944 A1 4/2012 Recker et al.
2012/0081009 A1 4/2012 Shteynberg et al.
2012/0081032 A1 4/2012 Huang

(56) References Cited

U.S. PATENT DOCUMENTS

2012/0081035 A1 4/2012 McCune, Jr.
2012/0146526 A1 6/2012 Lam et al.
2012/0181944 A1 7/2012 Jacobs et al.
2012/0181946 A1 7/2012 Melanson
2012/0187857 A1 7/2012 Ulmann et al.
2012/0242237 A1 9/2012 Chen et al.
2012/0262093 A1 10/2012 Recker et al.
2012/0268031 A1 10/2012 Zhou et al.
2012/0274227 A1 11/2012 Zheng et al.
2012/0286679 A1 11/2012 Liu
2012/0299500 A1 11/2012 Sadwick et al.
2012/0299501 A1 11/2012 Kost et al.
2012/0299511 A1 11/2012 Montante et al.
2012/0319604 A1 12/2012 Walters
2012/0326616 A1 12/2012 Sumitani et al.
2013/0009561 A1 1/2013 Briggs
2013/0020965 A1 1/2013 Kang et al.
2013/0026942 A1 1/2013 Ryan et al.
2013/0026945 A1 1/2013 Ganick et al.
2013/0027528 A1 1/2013 Staats et al.
2013/0034172 A1 2/2013 Pettler et al.
2013/0043726 A1 2/2013 Krishnamoorthy et al.
2013/0049631 A1 2/2013 Riesebosch
2013/0063047 A1 3/2013 Veskovic
2013/0134904 A1 5/2013 Yau et al.
2013/0141001 A1 6/2013 Datta et al.
2013/0154487 A1 6/2013 Kuang et al.
2013/0162155 A1 6/2013 Matsuda et al.
2013/0162158 A1 6/2013 Pollischansky
2013/0169177 A1 7/2013 Liao et al.
2013/0175931 A1 7/2013 Sadwick
2013/0181630 A1 7/2013 Pale et al.
2013/0187568 A1 7/2013 Jelaca et al.
2013/0193866 A1 8/2013 Datta et al.
2013/0193879 A1* 8/2013 Sadwick ..... H05B 45/385
315/307
2013/0194848 A1 8/2013 Bernardinis et al.
2013/0215655 A1 8/2013 Yang et al.
2013/0223107 A1 8/2013 Zhang et al.
2013/0229121 A1 9/2013 Otake et al.
2013/0241427 A1 9/2013 Kesterson et al.
2013/0241428 A1 9/2013 Takeda
2013/0241441 A1 9/2013 Myers et al.
2013/0242622 A1 9/2013 Peng et al.
2013/0249431 A1 9/2013 Shteynberg et al.
2013/0278159 A1 10/2013 Del et al.
2013/0307430 A1 11/2013 Blom
2013/0307431 A1 11/2013 Zhu et al.
2013/0307434 A1 11/2013 Zhang et al.
2013/0342127 A1 12/2013 Pan et al.
2013/0343090 A1 12/2013 Eom et al.
2014/0009082 A1 1/2014 King et al.
2014/0029315 A1 1/2014 Zhang et al.
2014/0049177 A1 2/2014 Kulczycki et al.
2014/0063857 A1 3/2014 Peng et al.
2014/0078790 A1 3/2014 Lin et al.
2014/0103829 A1 4/2014 Kang
2014/0132172 A1 5/2014 Zhu et al.
2014/0160809 A1 6/2014 Lin et al.
2014/0176016 A1 6/2014 Li et al.
2014/0177280 A1 6/2014 Yang et al.
2014/0197760 A1 7/2014 Radermacher
2014/0265898 A1 9/2014 Del et al.
2014/0265907 A1 9/2014 Su et al.
2014/0265935 A1 9/2014 Sadwick et al.
2014/0268935 A1 9/2014 Chiang
2014/0300274 A1 10/2014 Acatrinei
2014/0320031 A1 10/2014 Wu et al.
2014/0333228 A1 11/2014 Angeles et al.
2014/0346973 A1 11/2014 Zhu et al.
2014/0354157 A1 12/2014 Morales
2014/0354165 A1 12/2014 Malyna et al.
2014/0354170 A1 12/2014 Gredler et al.
2015/0015159 A1 1/2015 Wang et al.
2015/0035450 A1 2/2015 Werner
2015/0048757 A1 2/2015 Boonen et al.
2015/0062981 A1 3/2015 Fang et al.
2015/0077009 A1 3/2015 Kunimatsu
2015/0091470 A1 4/2015 Zhou et al.
2015/0137704 A1 5/2015 Angeles et al.
2015/0173140 A1 6/2015 Wu et al.
2015/0312978 A1 10/2015 Vaughan et al.
2015/0312982 A1 10/2015 Melanson
2015/0312988 A1 10/2015 Liao et al.
2015/0318789 A1 11/2015 Yang et al.
2015/0333764 A1 11/2015 Pastore et al.
2015/0357910 A1 12/2015 Murakami et al.
2015/0359054 A1 12/2015 Lin et al.
2015/0366010 A1 12/2015 Mao et al.
2015/0382424 A1 12/2015 Knapp et al.
2016/0014861 A1 1/2016 Zhu et al.
2016/0014865 A1 1/2016 Zhu et al.
2016/0037604 A1 2/2016 Zhu et al.
2016/0113077 A1 4/2016 Akiyama
2016/0119998 A1 4/2016 Linnartz et al.
2016/0128142 A1 5/2016 Arulandu et al.
2016/0134187 A1 5/2016 Pregitzer et al.
2016/0277411 A1 9/2016 Dani et al.
2016/0286617 A1 9/2016 Takahashi et al.
2016/0323957 A1 11/2016 Hu et al.
2016/0338163 A1 11/2016 Zhu et al.
2017/0006684 A1 1/2017 Tu et al.
2017/0027029 A1 1/2017 Hu et al.
2017/0055323 A1 2/2017 Lim et al.
2017/0064787 A1 3/2017 Liao et al.
2017/0099712 A1 4/2017 Hilgers et al.
2017/0181235 A1 6/2017 Zhu et al.
2017/0196063 A1 7/2017 Zhu et al.
2017/0251532 A1 8/2017 Wang et al.
2017/0311409 A1 10/2017 Zhu et al.
2017/0354008 A1 12/2017 Eum et al.
2017/0359880 A1 12/2017 Zhu et al.
2018/0035507 A1 2/2018 Kumada et al.
2018/0103520 A1 4/2018 Zhu et al.
2018/0110104 A1 4/2018 Liang et al.
2018/0115234 A1 4/2018 Liu et al.
2018/0139816 A1 5/2018 Liu et al.
2018/0263089 A1 9/2018 Seyler et al.
2018/0288845 A1 10/2018 Zhu et al.
2018/0310376 A1 10/2018 Huang et al.
2019/0069364 A1 2/2019 Zhu et al.
2019/0069366 A1 2/2019 Liao et al.
2019/0082507 A1 3/2019 Zhu et al.
2019/0104583 A1 4/2019 Konishi et al.
2019/0124736 A1 4/2019 Zhu et al.
2019/0166667 A1 5/2019 Li et al.
2019/0230755 A1 7/2019 Zhu et al.
2019/0327810 A1 10/2019 Zhu et al.
2019/0350055 A1 11/2019 Wu et al.
2019/0350060 A1 11/2019 Li et al.
2019/0364628 A1 11/2019 Chen et al.
2019/0380183 A1 12/2019 Li et al.
2020/0100340 A1 3/2020 Zhu et al.
2020/0146121 A1 5/2020 Zhu et al.
2020/0205263 A1 6/2020 Zhu et al.
2020/0205264 A1 6/2020 Zhu et al.
2020/0267817 A1 8/2020 Yang et al.
2020/0305247 A1 9/2020 Li et al.
2020/0375001 A1 11/2020 Jung et al.
2021/0007195 A1 1/2021 Zhu et al.
2021/0007196 A1 1/2021 Zhu et al.
2021/0045213 A1 2/2021 Zhu et al.
2021/0153313 A1 5/2021 Li et al.
2021/0195709 A1 6/2021 Li et al.
2021/0204375 A1 7/2021 Li et al.
2022/0038085 A1 2/2022 Zhu et al.
2022/0149829 A1 5/2022 Zhu et al.
2022/0209762 A1 6/2022 Zhu et al.
2022/0210880 A1 6/2022 Li et al.

(56) References Cited

U.S. PATENT DOCUMENTS

| | | | |
|---|---|---|---|
| 2022/0217824 | A1 | 7/2022 | Zhu et al. |
| 2022/0225480 | A1 | 7/2022 | Li et al. |

FOREIGN PATENT DOCUMENTS

| | | | |
|---|---|---|---|
| CN | 101657057 | A | 2/2010 |
| CN | 101868090 | A | 10/2010 |
| CN | 101896022 | A | 11/2010 |
| CN | 101917804 | A | 12/2010 |
| CN | 101938865 | A | 1/2011 |
| CN | 101998734 | A | 3/2011 |
| CN | 102014540 | A | 4/2011 |
| CN | 102014551 | A | 4/2011 |
| CN | 102056378 | A | 5/2011 |
| CN | 102209412 | A | 10/2011 |
| CN | 102300375 | A | 12/2011 |
| CN | 102347607 | A | 2/2012 |
| CN | 102387634 | A | 3/2012 |
| CN | 102474953 | A | 5/2012 |
| CN | 102497706 | A | 6/2012 |
| CN | 102612194 | A | 7/2012 |
| CN | 202353859 | U | 7/2012 |
| CN | 102668717 | A | 9/2012 |
| CN | 102695330 | A | 9/2012 |
| CN | 102791056 | A | 11/2012 |
| CN | 102843836 | A | 12/2012 |
| CN | 202632722 | U | 12/2012 |
| CN | 102870497 | A | 1/2013 |
| CN | 102946674 | A | 2/2013 |
| CN | 103004290 | A | 3/2013 |
| CN | 103024994 | A | 4/2013 |
| CN | 103096606 | A | 5/2013 |
| CN | 103108470 | A | 5/2013 |
| CN | 103260302 | A | 8/2013 |
| CN | 103313472 | A | 9/2013 |
| CN | 103369802 | A | 10/2013 |
| CN | 103379712 | A | 10/2013 |
| CN | 103428953 | A | 12/2013 |
| CN | 103458579 | A | 12/2013 |
| CN | 103547014 | A | 1/2014 |
| CN | 103648219 | A | 3/2014 |
| CN | 103716934 | A | 4/2014 |
| CN | 103781229 | A | 5/2014 |
| CN | 103858524 | A | 6/2014 |
| CN | 203675408 | U | 6/2014 |
| CN | 103945614 | A | 7/2014 |
| CN | 103957634 | A | 7/2014 |
| CN | 102612194 | B | 8/2014 |
| CN | 104066254 | A | 9/2014 |
| CN | 103096606 | B | 12/2014 |
| CN | 104619077 | A | 5/2015 |
| CN | 204392621 | U | 6/2015 |
| CN | 104768265 | A | 7/2015 |
| CN | 104902653 | A | 9/2015 |
| CN | 105072742 | A | 11/2015 |
| CN | 105246218 | A | 1/2016 |
| CN | 105265019 | A | 1/2016 |
| CN | 105423140 | A | 3/2016 |
| CN | 105591553 | A | 5/2016 |
| CN | 105873269 | A | 8/2016 |
| CN | 105992440 | A | 10/2016 |
| CN | 106105395 | A | 11/2016 |
| CN | 106163009 | A | 11/2016 |
| CN | 205812458 | U | 12/2016 |
| CN | 106332374 | A | 1/2017 |
| CN | 106332390 | A | 1/2017 |
| CN | 106358337 | A | 1/2017 |
| CN | 106413189 | A | 2/2017 |
| CN | 206042434 | U | 3/2017 |
| CN | 106604460 | A | 4/2017 |
| CN | 106793246 | A | 5/2017 |
| CN | 106888524 | A | 6/2017 |
| CN | 106912144 | A | 6/2017 |
| CN | 107046751 | A | 8/2017 |
| CN | 107069726 | A | 8/2017 |
| CN | 106888524 | B | 1/2018 |
| CN | 107645804 | A | 1/2018 |
| CN | 107995747 | A | 5/2018 |
| CN | 107995750 | A | 5/2018 |
| CN | 207460551 | U | 6/2018 |
| CN | 108337764 | A | 7/2018 |
| CN | 108366460 | A | 8/2018 |
| CN | 207744191 | U | 8/2018 |
| CN | 207910676 | U | 9/2018 |
| CN | 108834259 | A | 11/2018 |
| CN | 109246885 | A | 1/2019 |
| CN | 208572500 | U | 3/2019 |
| CN | 109729621 | A | 5/2019 |
| CN | 110086362 | A | 8/2019 |
| CN | 110099495 | A | 8/2019 |
| CN | 110493913 | A | 11/2019 |
| EP | 2403318 | A1 | 1/2012 |
| EP | 2590477 | A1 | 5/2013 |
| EP | 2938164 | A2 | 10/2015 |
| JP | 2008-010152 | A | 1/2008 |
| JP | 2011-249328 | A | 12/2011 |
| TW | 201125441 | A | 7/2011 |
| TW | 201132241 | A | 9/2011 |
| TW | 201143501 | A | 12/2011 |
| TW | 201143530 | A | 12/2011 |
| TW | 201146087 | A | 12/2011 |
| TW | 201204168 | A | 1/2012 |
| TW | 201208463 | A | 2/2012 |
| TW | 201208481 | A | 2/2012 |
| TW | 201208486 | A | 2/2012 |
| TW | 201215228 | A | 4/2012 |
| TW | 201233021 | A | 8/2012 |
| TW | 201244543 | A | 11/2012 |
| TW | I387396 | B | 2/2013 |
| TW | 201315118 | A | 4/2013 |
| TW | 201322825 | A | 6/2013 |
| TW | 201336345 | A | 9/2013 |
| TW | 201342987 | A | 10/2013 |
| TW | 201348909 | A | 12/2013 |
| TW | I422130 | B | 1/2014 |
| TW | I423732 | B | 1/2014 |
| TW | 201412189 | A | 3/2014 |
| TW | 201414146 | A | 4/2014 |
| TW | I434616 | B | 4/2014 |
| TW | M477115 | U | 4/2014 |
| TW | 201417626 | A | 5/2014 |
| TW | 201417631 | A | 5/2014 |
| TW | 201422045 | A | 6/2014 |
| TW | 201424454 | A | 6/2014 |
| TW | I441428 | B | 6/2014 |
| TW | I448198 | B | 8/2014 |
| TW | 201503756 | A | 1/2015 |
| TW | 201515514 | A | 4/2015 |
| TW | I496502 | B | 8/2015 |
| TW | 201603644 | A | 1/2016 |
| TW | 201607368 | A | 2/2016 |
| TW | I524814 | B | 3/2016 |
| TW | I535175 | B | 5/2016 |
| TW | I540809 | B | 7/2016 |
| TW | 201630468 | A | 8/2016 |
| TW | 201639415 | A | 11/2016 |
| TW | I630842 | B | 7/2018 |
| TW | 201909699 | A | 3/2019 |
| TW | 201927074 | A | 7/2019 |
| WO | WO-2008112820 | A2 * | 9/2008 ..... H03K 17/18 |

OTHER PUBLICATIONS

United States Patent and Trademark Office, Notice of Allowance dated Jun. 24, 2022, in U.S. Appl. No. 17/096,741.

United States Patent and Trademark Office, Notice of Allowance dated Nov. 2, 2022, in U.S. Appl. No. 17/023,632.

United States Patent and Trademark Office, Notice of Allowance dated Oct. 3, 2022, in U.S. Appl. No. 17/023,615.

United States Patent and Trademark Office, Notice of Allowance dated Oct. 4, 2021, in U.S. Appl. No. 17/096,741.

United States Patent and Trademark Office, Notice of Allowance dated Oct. 4, 2022, in U.S. Appl. No. 17/554,306.

(56) References Cited

OTHER PUBLICATIONS

United States Patent and Trademark Office, Notice of Allowance dated Sep. 12, 2022, in U.S. Appl. No. 17/023,632.
United States Patent and Trademark Office, Notice of Allowance dated Sep. 29, 2022, in U.S. Appl. No. 17/096,741.
United States Patent and Trademark Office, Office Action dated Dec. 15, 2021, in U.S. Appl. No. 17/023,632.
United States Patent and Trademark Office, Office Action dated Oct. 5, 2021, in U.S. Appl. No. 17/023,615.
United States Patent and Trademark Office, Office Action dated Apr. 26, 2022, in U.S. Appl. No. 17/023,632.
United States Patent and Trademark Office, Office Action dated Mar. 15, 2022, in U.S. Appl. No. 17/023,615.
United States Patent and Trademark Office, Office Action dated Oct. 19, 2022, in U.S. Appl. No. 17/520,573.
United States Patent and Trademark Office, Office Action dated Oct. 5, 2022, in U.S. Appl. No. 17/502,916.
United States Patent and Trademark Office, Office Action dated Sep. 12, 2022, in U.S. Appl. No. 17/503,238.
United States Patent and Trademark Office, Office Action dated Sep. 14, 2022, in U.S. Appl. No. 17/545,752.
United States Patent and Trademark Office, Office Action dated Sep. 16, 2022, in U.S. Appl. No. 17/578,706.
China Patent Office, Notice of Allowance dated Sep. 1, 2021, in Application No. 201911371960.8.
China Patent Office, Office Action dated Apr. 15, 2021, in Application No. 201911371960.8.
China Patent Office, Office Action dated Apr. 30, 2021, in Application No. 201910719931 X.
China Patent Office, Office Action dated Aug. 28, 2015, in Application No. 201410322602.9.
China Patent Office, Office Action dated Aug. 8, 2015, in Application No. 201410172086.6.
China Patent Office, Office Action dated Dec. 14, 2015, in Application No. 201210166672.0.
China Patent Office, Office Action dated Dec. 3, 2018, in Application No. 201710557179.4.
China Patent Office, Office Action dated Feb. 1, 2021, in Application No. 201911140844.5.
China Patent Office, Office Action dated Feb. 3, 2021, in Application No. 201911316902.5.
China Patent Office, Office Action dated Jan. 17, 2022, in Application No. 201910124049.0.
China Patent Office, Office Action dated Jan. 9, 2020, in Application No. 201710828263.5.
China Patent Office, Office Action dated Jul. 7, 2014, in Application No. 201210468505.1.
China Patent Office, Office Action dated Jun. 3, 2014, in Application No. 201110103130.4.
China Patent Office, Office Action dated Jun. 30, 2015, in Application No. 201410171893.6.
China Patent Office, Office Action dated Mar. 2, 2016, in Application No. 201410172086.6.
China Patent Office, Office Action dated Mar. 22, 2016, in Application No. 201410322612.2.
China Patent Office, Office Action dated Mar. 22, 2019, in Application No. 201711464007.9.
China Patent Office, Office Action dated May 26, 2021, in Application No. 201910124049.0.
China Patent Office, Office Action dated Nov. 15, 2014, in Application No. 201210166672.0.
China Patent Office, Office Action dated Nov. 15, 2021, in Application No. 201911316902.5.
China Patent Office, Office Action dated Nov. 2, 2020, in Application No. 201910124049.0.
China Patent Office, Office Action dated Nov. 23, 2021, in Application No. 201911140844.5.
China Patent Office, Office Action dated Nov. 29, 2018, in Application No. 201710828263.5.
China Patent Office, Office Action dated Oct. 19, 2015, in Application No. 201410322612.2.
China Patent Office, Office Action dated Sep. 2, 2016, in Application No. 201510103579.9.
Qi et al., "Sine Wave Dimming Circuit Based on PIC16 MCU," Electronic Technology Application in 2014, vol. 10, (2014).
Taiwan Intellectual Property Office, Office Action dated Apr. 18, 2016, in Application No. 103140989.
Taiwan Intellectual Property Office, Office Action dated Apr. 27, 2020, in Application No. 108116002.
Taiwan Intellectual Property Office, Office Action dated Apr. 7, 2021, in Application No. 109111042.
Taiwan Intellectual Property Office, Office Action dated Aug. 23, 2017, in Application No. 106103535.
Taiwan Intellectual Property Office, Office Action dated Aug. 27, 2020, in Application No. 107107508.
Taiwan Intellectual Property Office, Office Action dated Dec. 27, 2019, in Application No. 108116002.
Taiwan Intellectual Property Office, Office Action dated Feb. 11, 2020, in Application No. 107107508.
Taiwan Intellectual Property Office, Office Action dated Feb. 27, 2018, in Application No. 106136242.
Taiwan Intellectual Property Office, Office Action dated Feb. 6, 2018, in Application No. 106130686.
Taiwan Intellectual Property Office, Office Action dated Jan. 14, 2019, in Application No. 107107508.
Taiwan Intellectual Property Office, Office Action dated Jan. 21, 2021, in Application No. 109108798.
Taiwan Intellectual Property Office, Office Action dated Jan. 4, 2021, in Application No. 109111042.
Taiwan Intellectual Property Office, Office Action dated Jan. 7, 2014, in Application No. 100119272.
Taiwan Intellectual Property Office, Office Action dated Jun. 16, 2020, in Application No. 108136083.
Taiwan Intellectual Property Office, Office Action dated Jun. 9, 2014, in Application No. 101124982.
Taiwan Intellectual Property Office, Office Action dated May 28, 2019, in Application No. 107112306.
Taiwan Intellectual Property Office, Office Action dated Nov. 13, 2015, in Application No. 103141628.
Taiwan Intellectual Property Office, Office Action dated Nov. 30, 2020, in Application No. 107107508.
Taiwan Intellectual Property Office, Office Action dated Oct. 31, 2019, in Application No. 107107508.
Taiwan Intellectual Property Office, Office Action dated Sep. 17, 2015, in Application No. 103127108.
Taiwan Intellectual Property Office, Office Action dated Sep. 17, 2015, in Application No. 103127620.
Taiwan Intellectual Property Office, Office Action dated Sep. 25, 2014, in Application No. 101148716.
Taiwan Intellectual Property Office, Office Action dated Sep. 9, 2020, in Application No. 108148566.
United States Patent and Trademark Office, Notice of Allowance dated Jan. 28, 2022, in U.S. Appl. No. 17/096,741.
United States Patent and Trademark Office, Office Action dated Mar. 22, 2023, in U.S. Appl. No. 17/502,916.
United States Patent and Trademark Office, Office Action dated Feb. 3, 2023, in U.S. Appl. No. 17/503,238.
United States Patent and Trademark Office, Notice of Allowance dated Feb. 14, 2023, in U.S. Appl. No. 17/520,573.
United States Patent and Trademark Office, Notice of Allowance dated Feb. 8, 2023, in U.S. Appl. No. 17/554,306.
United States Patent and Trademark Office, Office Action dated Jan. 26, 2023, in U.S. Appl. No. 17/578,706.
United States Patent and Trademark Office, Notice of Allowance dated Apr. 12, 2023, in U.S. Appl. No. 17/545,752.

* cited by examiner 420
430
1 cycle
Φ=0
Φ=Φ_J
Φ=Φ_K
Φ=π
Φ=π+Φ_J
Φ=π+Φ_K
Φ=2π
t1
t2
t3
t4
t5
t6
t7
Vs
t

SYSTEMS AND METHODS WITH TRIAC DIMMERS FOR VOLTAGE CONVERSION RELATED TO LIGHT EMITTING DIODES

1. CROSS-REFERENCES TO RELATED APPLICATIONS

This application is a continuation of U.S. patent application Ser. No. 16/791,329, filed Feb. 14, 2020, which claims priority to Chinese Patent Application No. 201910124049.0, filed Feb. 19, 2019, both applications being incorporated by reference herein for all purposes.

2. BACKGROUND OF THE INVENTION

Certain embodiments of the present invention are directed to integrated circuits. More particularly, some embodiments of the invention provide systems and methods for voltage conversion. Merely by way of example, some embodiments of the invention have been applied to light emitting diode (LED) lighting systems that include TRIAC dimmers. But it would be recognized that the invention has a much broader range of applicability.

A conventional lighting system often includes a TRIAC dimmer that is a dimmer including a Triode for Alternating Current (TRIAC). For example, the TRIAC dimmer is either a leading-edge TRIAC dimmer or a trailing-edge TRIAC dimmer. Usually, the leading-edge TRIAC dimmer and the trailing-edge TRIAC dimmer are configured to receive an alternating-current (AC) input voltage, process the AC input voltage by clipping part of the waveform of the AC input voltage, and generate a voltage that is then received by a rectifier (e.g., a full wave rectifying bridge) in order to generate a rectified output voltage. The rectified output voltage is converted to a DC voltage by an RC filtering circuit that includes a resistor and a capacitor, and the DC voltage is then used to control a driver to generate a drive signal for one or more light emitting diodes (LEDs).

FIG. 1 is a simplified diagram of a conventional lighting system that includes a TRIAC dimmer. The conventional lighting system 100 includes a TRIAC dimmer 110, a rectifier 120, resistors 170, 172 and 174, a capacitor 180, a driver 140, and one or more LEDs 150. As shown, the resistors 170 and 172 are parts of a voltage divider, and the resistor 174 and the capacitor 180 are parts of an RC filtering circuit. For example, the rectifier 120 is a full wave rectifying bridge that includes diodes 132, 134, 136 and 138.

The TRIAC dimmer 110 receives an AC input voltage 114 (e.g., VLine) and generates a voltage 112. The voltage 112 is received by the rectifier 120 (e.g., a full wave rectifying bridge), which then generates a rectified output voltage 122. The rectified output voltage 122 is larger than or equal to zero. As shown in FIG. 1, the rectified output voltage 122 is received by the resistor 170 and the one or more LEDs 150. In response, the voltage divider including the resistors 170 and 172 generates a voltage 182 (e.g., $V_s$), as follows:

$$V_s = \frac{R_2}{R_1 + R_2} \times V_o \quad \text{(Equation 1)}$$

where $V_s$ represents the voltage 182, and $V_o$ represents the voltage 122. Additionally, $R_1$ represents the resistance of the resistor 170, and $R_2$ represents the resistance of the resistor 172. The voltage 182 (e.g., $V_s$) is received by the resistor 174. In response, the RC filtering circuit including the resistor 174 and the capacitor 180 generates a reference voltage 184 (e.g., VREF). For example, the reference voltage 184 (e.g., $V_{REF}$) is a DC voltage. The reference voltage 184 is received by the driver 140, which in response affects (e.g., controls) a load current 142 that flows through the one or more LEDs 150. Referring to FIG. 1, each cycle of the AC input voltage 114 (e.g., $V_{Line}$) has a phase angel (e.g., $\phi$) that changes from 0 to $\pi$ and then from $\pi$ to $2\pi$.

FIG. 2A shows a conventional timing diagram for the voltage 182 of the lighting system 100 that includes a leading-edge TRIAC dimmer as the TRIAC dimmer 110, and FIG. 2B shows a conventional timing diagram for the voltage 182 of the lighting system 100 that includes a trailing-edge TRIAC dimmer as the TRIAC dimmer 110. For each cycle of the AC input voltage 114 (e.g., $V_{Line}$), time $t_1$ corresponds to phase 0, time $t_2$ corresponds to phase $\phi_J$, time $t_3$ corresponds to phase $\phi_K$, time $t_4$ corresponds to phase $\pi$, time is corresponds to phase $\pi+\phi_J$, time $t_6$ corresponds to phase $\pi+\phi_K$, and time $t_7$ corresponds to phase $2\pi$.

As shown in FIG. 2A, the waveform 220 represents the voltage 182 (e.g., $V_s$) as a function of time if the TRIAC dimmer 110 is a leading-edge TRIAC dimmer. The leading-edge TRIAC dimmer processes the AC input voltage 114 (e.g., $V_{Line}$) by clipping part of the waveform that corresponds to the phase starting at 0 and ending at $\phi_J$ and clipping part of the waveform that corresponds to the phase starting at $\pi$ and ending at $\pi+\phi_J$, for each cycle of the AC input voltage 114 (e.g., $V_{Line}$). For each cycle, the AC input voltage 114 (e.g., $V_{Line}$) is clipped by the leading-edge TRIAC dimmer from time $t_1$ to time $t_2$ and from time $t_4$ to time $t_5$, but the AC input voltage 114 (e.g., $V_{Line}$) is not clipped by the leading-edge TRIAC dimmer from time $t_2$ to time $t_4$ and from time $t_5$ to time $t_7$.

As shown in FIG. 2B, the waveform 230 represents the voltage 182 (e.g., $V_s$) as a function of time if the TRIAC dimmer 110 is a trailing-edge TRIAC dimmer. The trailing-edge TRIAC dimmer processes the AC input voltage 114 (e.g., $V_{Line}$) by clipping part of the waveform that corresponds to the phase starting at $\phi_K$ and ending at $\pi$ and clipping part of the waveform that corresponds to the phase starting at $\phi+\phi_K$ and ending at $2\pi$, for each cycle of the AC input voltage 114 (e.g., $V_{Line}$). For each cycle, the AC input voltage 114 (e.g., $V_{Line}$) is clipped by the trailing-edge TRIAC dimmer from time $t_3$ to time $t_4$ and from time $t_6$ to time $t_7$, but the AC input voltage 114 (e.g., $V_{Line}$) is not clipped by the leading-edge TRIAC dimmer from time $t_1$ to time $t_3$ and from time $t_4$ to time $t_6$.

As shown in FIG. 1, it is often difficult to integrate the RC filtering circuit into an integrated circuit (IC) chip with limited size. Hence it is highly desirable to improve the LED drive techniques that use one or more TRIAC dimmers.

3. BRIEF SUMMARY OF THE INVENTION

Certain embodiments of the present invention are directed to integrated circuits. More particularly, some embodiments of the invention provide systems and methods for voltage conversion. Merely by way of example, some embodiments of the invention have been applied to light emitting diode (LED) lighting systems that include TRIAC dimmers. But it would be recognized that the invention has a much broader range of applicability.

According to some embodiments, a system for voltage conversion to drive one or more light emitting diodes with at least a TRIAC dimmer, the system comprising: a phase detector configured to receive a first rectified voltage generated based at least in part on an AC input voltage processed by at least the TRIAC dimmer, the phase detector being further configured to generate a digital signal representing phase information associated with the first rectified voltage; a voltage generator configured to receive the digital signal and generate a DC voltage based at least in part on the digital signal; and a driver configured to receive the DC voltage and affect, based at least in part on the DC voltage, a current flowing through the one or more light emitting diodes; wherein the current changes with the phase information according to a predetermined function.

According to certain embodiments, a method for voltage conversion to drive one or more light emitting diodes with at least a TRIAC dimmer, the method comprising: receiving a first rectified voltage generated based at least in part on an AC input voltage processed by at least the TRIAC dimmer; processing at least information associated with the first rectified voltage; generating a digital signal representing phase information associated with the first rectified voltage; receiving the digital signal; generating a DC voltage based at least in part on the digital signal; receiving the DC voltage; and affecting, based at least in part on the DC voltage, a current flowing through the one or more light emitting diodes; wherein the current changes with the phase information according to a predetermined function.

Depending upon embodiment, one or more benefits may be achieved. These benefits and various additional objects, features and advantages of the present invention can be fully appreciated with reference to the detailed description and accompanying drawings that follow.

4. BRIEF DESCRIPTION OF THE DRAWINGS

5. DETAILED DESCRIPTION OF THE INVENTION

Certain embodiments of the present invention are directed to integrated circuits. More particularly, some embodiments of the invention provide systems and methods for voltage conversion. Merely by way of example, some embodiments of the invention have been applied to light emitting diode (LED) lighting systems that include TRIAC dimmers. But it would be recognized that the invention has a much broader range of applicability.

Figure 1:
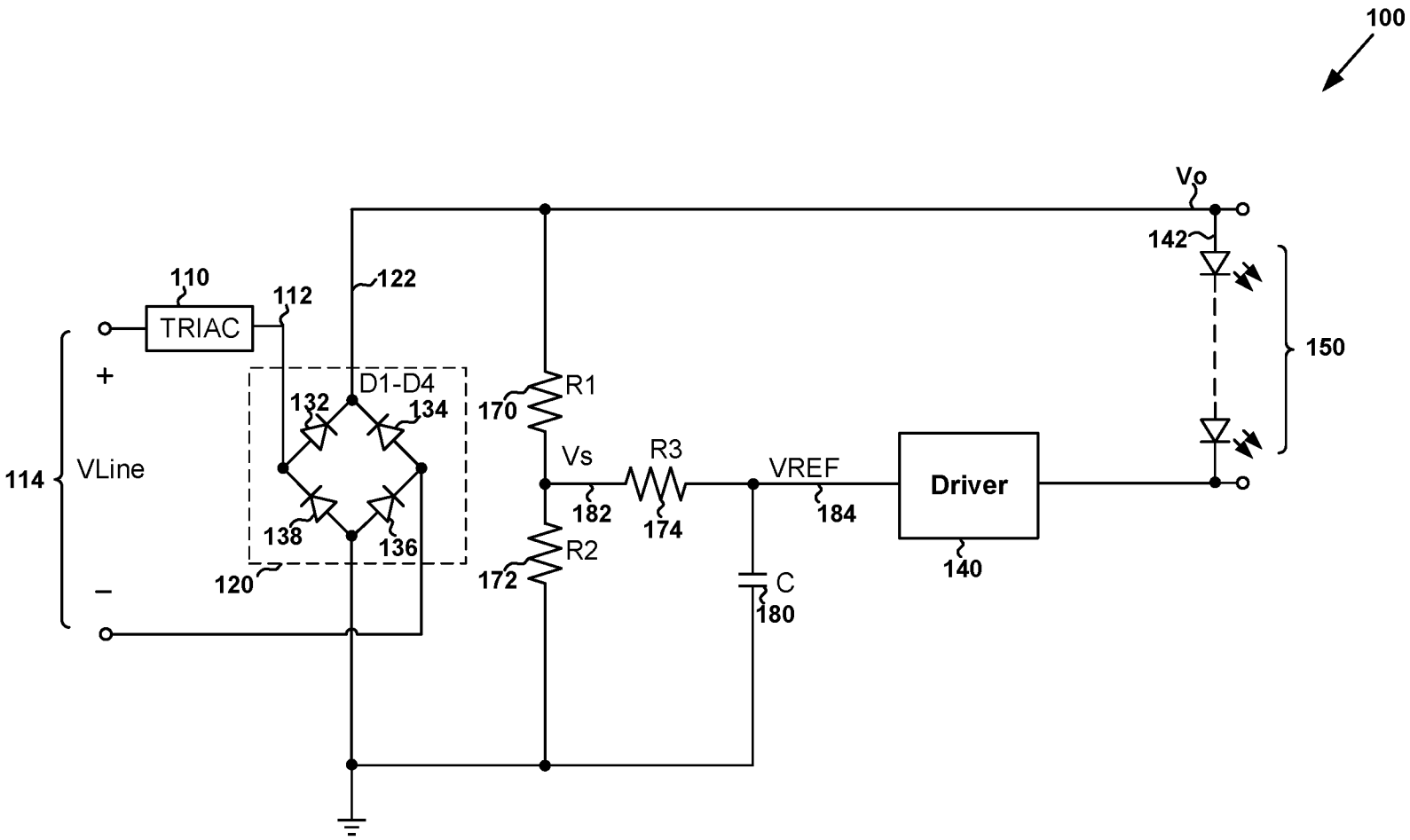
FIG. 1 (Prior Art)
FIG. 1 is a simplified diagram of a conventional lighting system that includes a TRIAC dimmer.
Figures 2A, 2B:
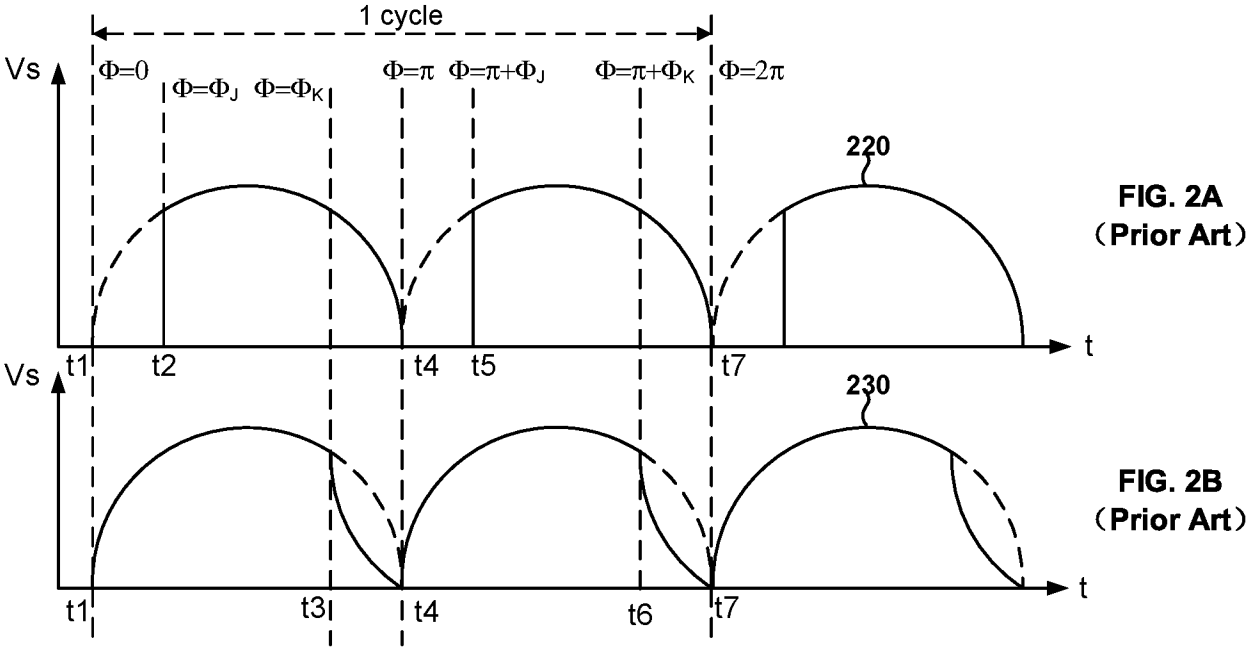
FIG. 2A (Prior Art)
FIG. 2B (Prior Art)
FIG. 2A shows a conventional timing diagram for a voltage of the lighting system as shown in FIG. 1 that includes a leading-edge TRIAC dimmer as the TRIAC dimmer.
FIG. 2B shows a conventional timing diagram for a voltage of the lighting system as shown in FIG. 1 that includes a trailing-edge TRIAC dimmer as the TRIAC dimmer.

Referring to FIG. 1, the conventional lighting system 100 uses the RC filtering circuit that includes the resistor 174 and the capacitor 180. In order to make the reference voltage 184 (e.g., $V_{REF}$) less dependent on time (e.g., to make the reference voltage 184 be a DC voltage), the RC time constant of the RC filtering circuit often needs to be large. For example, the RC time constant is determined as follows:

$$\tau = R_3 \times C \quad \text{(Equation 2)}$$

where $R_3$ represents the resistance of the resistor 174, and C represents the capacitance of the capacitor 180. As an example, if the capacitor 180 is a parallel plate capacitor, its capacitance is determined as follows:

$$C = \varepsilon \times \frac{A}{d} \quad \text{(Equation 3)}$$

where C represents the capacitance of the capacitor 180. Additionally, A represents the area of the smaller of the two conductive plates, and d represents the distance between the two conductive plates of the capacitor 180.

As shown in Equations 2 and 3, to increase the RC time constant, the area of the smaller of the two conductive plates may need to become larger. If the area of the smaller of the two conductive plates becomes larger, integrating the capacitor 180 into the IC chip becomes more difficult. Even though the techniques of equivalent capacitance can be used to help integrating the RC filtering circuit into the IC chip, the capacitor 180 often still occupies a significant area of the IC chip.

Figure 3:
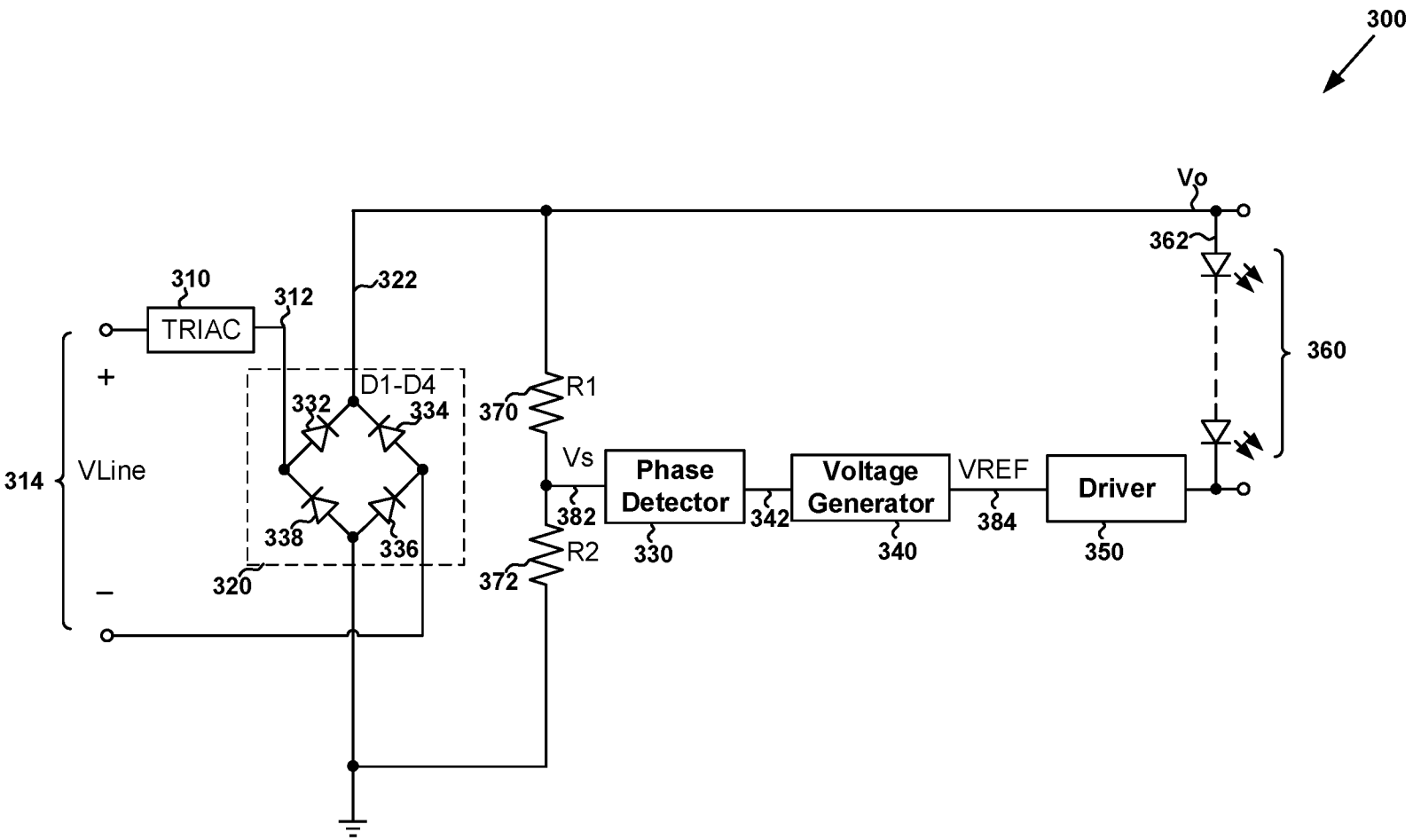
FIG. 3 is a simplified diagram of a lighting system that includes a TRIAC dimmer according to some embodiments of the present invention.

FIG. 3 is a simplified diagram of a lighting system that includes a TRIAC dimmer according to some embodiments of the present invention. This diagram is merely an example, which should not unduly limit the scope of the claims. One of ordinary skill in the art would recognize many variations, alternatives, and modifications. The lighting system 300 includes a TRIAC dimmer 310, a rectifier 320, resistors 370 and 372, a phase detector 330, a voltage generator 340, a driver 350, and one or more LEDs 360. For example, the resistors 370 and 372 are parts of a voltage divider. As an example, the rectifier 320 is a full wave rectifying bridge that includes diodes 332, 334, 336 and 338. Although the above has been shown using a selected group of components for the system, there can be many alternatives, modifications, and variations. For example, some of the components may be expanded and/or combined. Other components may be inserted to those noted above. Depending upon the embodiment, the arrangement of components may be interchanged with others replaced. Further details of these components are found throughout the present specification.

In certain embodiments, the TRIAC dimmer 310 receives an AC input voltage 314 (e.g., $V_{Line}$) and generates a voltage 312. For example, the voltage 312 is received by the rectifier 320 (e.g., a full wave rectifying bridge), which then generates a rectified output voltage 322. As an example, the rectified output voltage 322 is larger than or equal to zero. In some embodiments, as shown in FIG. 3, the rectified output voltage 322 is received by the resistor 370 and the one or more LEDs 360. For example, in response, the voltage divider including the resistors 370 and 372 generates a voltage 382 (e.g., $V_s$), as follows:

$$V_s = \frac{R_2}{R_1 + R_2} \times V_o \quad \text{(Equation 4)}$$

where $V_s$ represents the voltage 382, and $V_o$ represents the voltage 322. Additionally, $R_1$ represents the resistance of the resistor 370, and $R_2$ represents the resistance of the resistor 372. As an example, the voltage 382 (e.g., $V_s$) is a rectified voltage.

According to certain embodiments, the voltage 382 (e.g., $V_s$) is received by the phase detector 330. For example, the phase detector 330 and the voltage generator 340 convert the voltage 382 (e.g., $V_s$) to a reference voltage 384 (e.g., $V_{REF}$). As an example, the reference voltage 384 (e.g., $V_{REF}$) is a DC voltage. According to some embodiments, the reference voltage 384 is received by the driver 350, which in response affects (e.g., controls) a load current 362 that flows through the one or more LEDs 360. Referring to FIG. 3, as an example, each cycle of the AC input voltage 314 (e.g., $V_{Line}$) has a phase angel (e.g., $\phi$) that changes from 0 to $\pi$ and then from $\pi$ to $2\pi$.

Figures 4A, 4B:
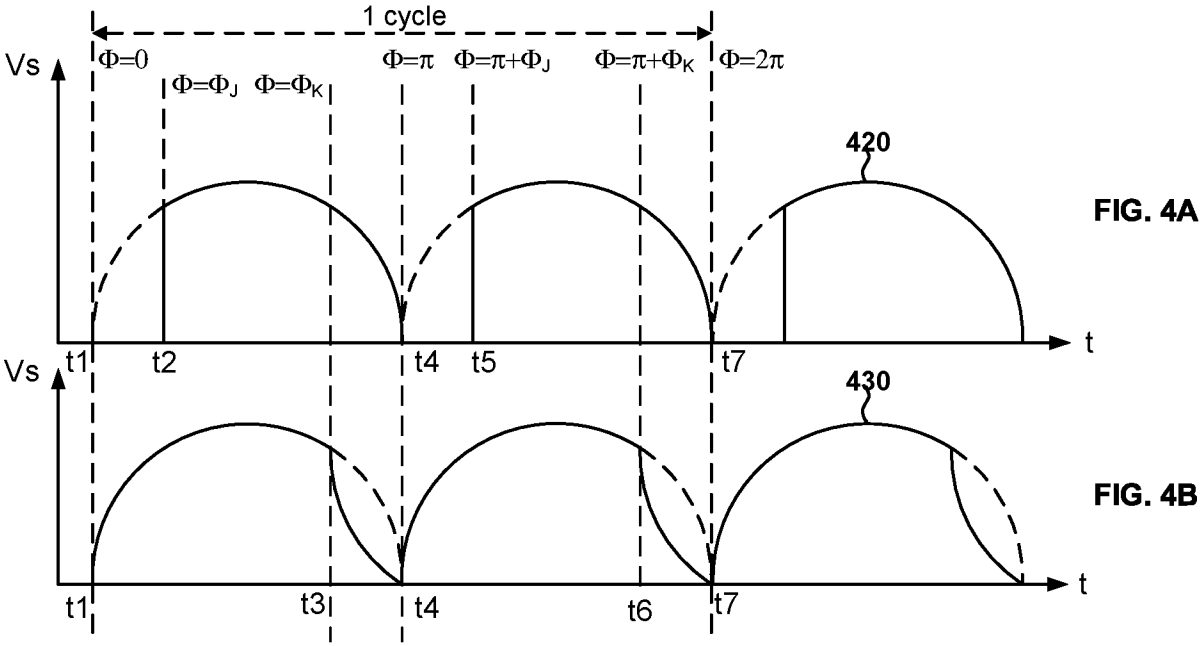
FIG. 4A shows a timing diagram for a voltage of the lighting system as shown in FIG. 3 that includes a leading-edge TRIAC dimmer as the TRIAC dimmer according to some embodiments of the present invention.
FIG. 4B shows a timing diagram for a voltage of the lighting system as shown in FIG. 3 that includes a trailing-edge TRIAC dimmer as the TRIAC dimmer according to certain embodiments of the present invention.

FIG. 4A shows a timing diagram for the voltage 382 of the lighting system 300 that includes a leading-edge TRIAC dimmer as the TRIAC dimmer 310 according to some embodiments of the present invention, and FIG. 4B shows a timing diagram for the voltage 382 of the lighting system 300 that includes a trailing-edge TRIAC dimmer as the TRIAC dimmer 310 according to certain embodiments of the present invention.

These diagrams are merely examples, which should not unduly limit the scope of the claims. One of ordinary skill in the art would recognize many variations, alternatives, and modifications. As an example, for each cycle of the AC input voltage 114 (e.g., $V_{Line}$), time $t_1$ corresponds to phase 0, time $t_2$ corresponds to phase $\phi_J$, time $t_3$ corresponds to phase $\phi_K$, time $t_4$ corresponds to phase $\pi$, time $t_5$ corresponds to phase $\pi+\phi_J$, time $t_6$ corresponds to phase $\pi+\phi_K$, and time $t_7$ corresponds to phase $2\pi$.

As shown in FIG. 4A, the waveform 420 represents the voltage 382 (e.g., $V_s$) as a function of time if the TRIAC dimmer 310 is a leading-edge TRIAC dimmer. For example, the leading-edge TRIAC dimmer processes the AC input voltage 314 (e.g., $V_{Line}$) by clipping part of the waveform that corresponds to the phase starting at 0 and ending at $\phi_J$ and clipping part of the waveform that corresponds to the phase starting at $\pi$ and ending at $\pi+\phi_J$, for each cycle of the AC input voltage 314 (e.g., $V_{Line}$). As an example, for each cycle, the AC input voltage 314 (e.g., $V_{Line}$) is clipped by the leading-edge TRIAC dimmer from time $t_1$ to time $t_2$ and from time $t_4$ to time $t_5$, but the AC input voltage 314 (e.g., $V_{Line}$) is not clipped by the leading-edge TRIAC dimmer from time $t_2$ to time $t_4$ and from time $t_5$ to time $t_7$.

As shown in FIG. 4B, the waveform 430 represents the voltage 382 (e.g., $V_s$) as a function of time if the TRIAC dimmer 310 is a trailing-edge TRIAC dimmer. For example, the trailing-edge TRIAC dimmer processes the AC input voltage 314 (e.g., $V_{Line}$) by clipping part of the waveform that corresponds to the phase starting at $\phi_K$ and ending at $\pi$ and clipping part of the waveform that corresponds to the phase starting at $\pi+\phi_K$ and ending at $2\pi$, for each cycle of the AC input voltage 314 (e.g., $V_{Line}$). As an example, for each cycle, the AC input voltage 314 (e.g., $V_{Line}$) is clipped by the trailing-edge TRIAC dimmer from time $t_3$ to time $t_4$ and from time $t_6$ to time $t_7$, but the AC input voltage 314 (e.g., $V_{Line}$) is not clipped by the leading-edge TRIAC dimmer from time $t_1$ to time $t_3$ and from time $t_4$ to time $t_6$.

Referring to FIG. 3, the phase detector 330 receives the voltage 382 (e.g., $V_s$) and generates a signal 342 (e.g., a digital signal) that represents phase information of the voltage 382 (e.g., $V_s$) according to some embodiments. In certain examples, the signal 342 (e.g., a digital signal) represents the phase change, within which, for each half cycle, the AC input voltage 314 (e.g., $V_{Line}$) is not clipped by the TRIAC dimmer 310. In some examples, one half cycle of the AC input voltage 314 corresponds to one cycle of the voltage 382. For example, as shown in FIG. 4A, the signal 342 (e.g., a digital signal) represents the phase change that is equal to $\pi-\phi_J$, which is calculated from either $\pi-_J$ or from $2\pi-(\pi+\phi_J)$. As an example, as shown in FIG. 4B, the signal 342 (e.g., a digital signal) represents the phase change that is equal to $\phi_K$, which is calculated from either $\phi_{K-0}$ or from $(\pi+\phi_K)-\pi$.

In some examples, the phase detector 330 determines the time duration, during which, for each half cycle, the AC input voltage 314 (e.g., $V_{Line}$) is not clipped by the TRIAC dimmer 310, and then uses this time duration to determine the phase change, within which, for each half cycle, the AC input voltage 314 (e.g., $V_{Line}$) is not clipped by the TRIAC dimmer 310. As an example, the phase change is determined as follows:

$$A = \frac{T_C}{T_A} \times \pi \quad \text{(Equation 5)}$$

where A represents the phase change, within which, for each half cycle, the AC input voltage 314 (e.g., $V_{Line}$) is not clipped by the TRIAC dimmer 310. Additionally, $T_C$ represents the time duration, during which, for each half cycle, the AC input voltage 314 (e.g., $V_{Line}$) is not clipped by the TRIAC dimmer 310. Moreover, $T_A$ represents the time duration of one half cycle of the AC input voltage 314 (e.g., $V_{Line}$). For example, one half cycle of the AC input voltage 314 (e.g., $V_{Line}$) is the same as one cycle of the voltage 382 (e.g., $V_s$) in duration.

According to certain embodiments, the phase detector 330 includes a counter. In some examples, the counter keeps counting when the AC input voltage 314 (e.g., $V_{Line}$) is not clipped by the TRIAC dimmer 310, but the counter does not count when the AC input voltage 314 (e.g., $V_{Line}$) is clipped by the TRIAC dimmer 310. In some examples, as shown in FIG. 4A, the counter starts counting from zero at time $t_2$ and stops counting at time $t_4$, resets to zero, and then starts counting again at time $t_5$ and stops counting at time $t_7$. For example, the total number of counts is the number of counts made by the counter either from time $t_2$ to time $t_4$ or from time $t_5$ to time $t_7$. In certain examples, as shown in FIG. 4B, the counter starts counting from zero at time $t_1$ and stops counting at time $t_3$, resets to zero, and then starts counting again at time $t_4$ and stops counting at time $t_6$. For example, the total number of counts is the number of counts made by the counter either from time $t_1$ to time $t_3$ or from time $t_4$ to time $t_6$.

In some embodiments, for each half cycle of the AC input voltage 314 (e.g., each cycle of the voltage 382), the total number of counts by the counter is used by the phase detector 330 to determine the time duration, during which, for each half cycle, the AC input voltage 314 (e.g., $V_{Line}$) is not clipped by the TRIAC dimmer 310. For example, as shown in FIG. 4A, the time duration is either equal to $t_4-t_2$ or equal to $t_7-t_5$, and the time duration is determined by multiplying the total number of counts by the time interval between two consecutive counts. As an example, as shown in FIG. 4B, the time duration is either equal to $t_3-t_1$ or equal to $t_6-t_4$, and the time duration is determined by multiplying the total number of counts by the time interval between two consecutive counts.

In certain embodiments, the phase detector 330 uses the total number of counts to determine the phase change, within which, for each half cycle, the AC input voltage 314 (e.g., $V_{Line}$) is not clipped by the TRIAC dimmer 310. As an example, the phase change is determined as follows:

$$A = \frac{C_C \times T_I}{T_A} \times \pi \quad \text{(Equation 6)}$$

where A represents the phase change, within which, for each half cycle, the AC input voltage 314 (e.g., $V_{Line}$) is not clipped by the TRIAC dimmer 310. Additionally, $C_C$ represents the total number of counts when, for each half cycle, the AC input voltage 314 (e.g., $V_{Line}$) is not clipped by the TRIAC dimmer 310. Moreover, $T_1$ represents the time interval between two consecutive counts. Also, $T_A$ represents the time duration of one half cycle of the AC input voltage 314 (e.g., $V_{Line}$). For example, one half cycle of the AC input voltage 314 (e.g., $V_{Line}$) is the same as one cycle of the voltage 382 (e.g., $V_s$) in duration.

Referring to FIG. 3, the voltage generator 340 receives the signal 342 (e.g., a digital signal) that represents the phase change, within which, for each half cycle, the AC input voltage 314 (e.g., $V_{Line}$) is not clipped by the TRIAC dimmer 310, and generates the reference voltage 384 (e.g., $V_{REF}$) according to some embodiments. For example, the reference voltage 384 (e.g., $V_{REF}$) is a DC voltage. As an example, the reference voltage 384 is received by the driver 350, which in response affects (e.g., controls) the load current 362 that flows through the one or more LEDs 360.

According to certain embodiments, the voltage generator 340 and the driver 350 use the signal 342 (e.g., a digital signal) to affect (e.g., to control) the load current 362. For example, the signal 342 (e.g., a digital signal) represents the phase change, within which, for each half cycle, the AC input voltage 314 (e.g., $V_{Line}$) is not clipped by the TRIAC dimmer 310. As an example, the load current 362 flows through the one or more LEDs 360.

Figure 5:
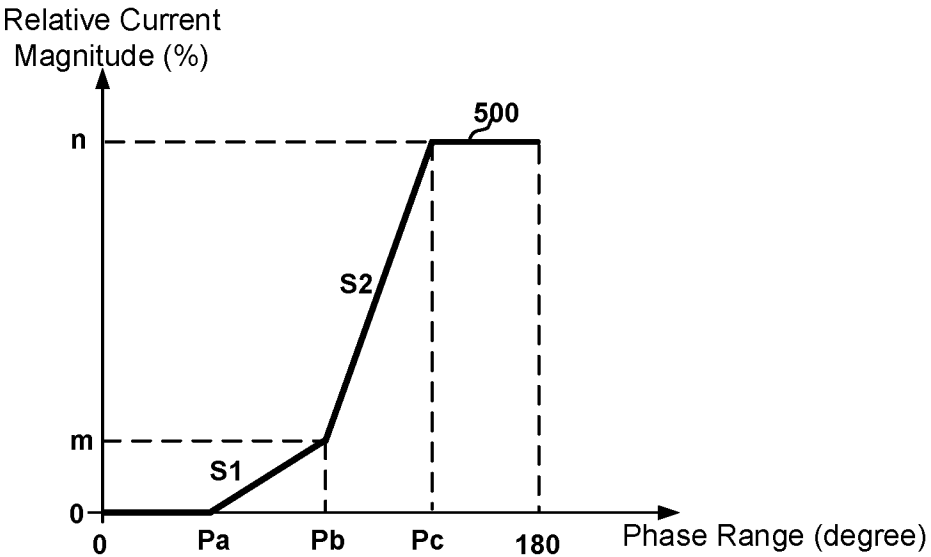
FIG. 5 is a simplified diagram showing a relative magnitude of the load current as a function of the phase change for the lighting system as shown in FIG. 3 according to some embodiments of the present invention.

FIG. 5 is a simplified diagram showing a relative magnitude of the load current 362 as a function of the phase change for the lighting system 300 according to some embodiments of the present invention. This diagram is merely an example, which should not unduly limit the scope of the claims. One of ordinary skill in the art would recognize many variations, alternatives, and modifications. For example, the curve 500 represents the relative magnitude of the load current 362 as a function of the phase change.

As shown in FIG. 5, the horizontal axis represents the phase change, within which, for each half cycle, the AC input voltage 314 (e.g., $V_{Line}$) is not clipped by the TRIAC dimmer 310 according to certain embodiments. In some examples, the phase change is represented in degrees. In certain examples, 0 degree corresponds to 0 for the phase change, and 180 degrees correspond to $\pi$ for the phase change. For example, 0 degree for the phase change indicates that an entire half cycle of the AC input voltage 314 (e.g., $V_{Line}$) is clipped by the TRIAC dimmer 310. As an example, 180 degrees for the phase change indicates none of a half cycle of the AC input voltage 314 (e.g., $V_{Line}$) is clipped by the TRIAC dimmer 310.

According to some embodiments, the vertical axis represents the relative magnitude of the load current 362 that flows through the one or more LEDs 360. In some examples, the relative magnitude is represented in percentage. For example, 0 percent (i.e., 0%) for the relative magnitude of the load current 362 indicates that the one or more LEDs 360 are completely turned off (e.g., to complete darkness). As an example, 100 percent (i.e., 100%) for the relative magnitude of the load current 362 indicates that the one or more LEDs 360 are completely turned on (e.g., to the maximum brightness).

In some embodiments, as shown by the curve 500, if the phase change is equal to or larger than 0 degree but smaller than Pa degrees, the relative magnitude of the load current 362 is equal to zero percent. In certain examples, if the phase change is larger than $P_a$ degrees but smaller than $P_b$ degrees, the relative magnitude of the load current 362 increases with the phase change linearly at a slope Si from zero percent to m percent. For example, if the phase change is equal to $P_a$ degrees, the relative magnitude of the load current 362 is equal to zero percent. As an example, if the phase change is equal to $P_b$ degrees, the relative magnitude of the load current 362 is equal to m percent. In some examples, if the phase change is larger than $P_b$ degrees but smaller than $P_c$ degrees, the relative magnitude of the load current 362 increases with the phase change linearly at a slope $S_2$ from m percent to n percent. For example, if the phase change is equal to $P_b$ degrees, the relative magnitude of the load current 362 is equal to m percent. As an example, if the phase change is equal to $P_c$ degrees, the relative magnitude of the load current 362 is equal to n percent. In certain examples, if the phase change is larger than $P_c$ degrees but smaller than or equal to 180 degrees, the relative magnitude of the load current 362 is equal to n percent. In certain embodiments, $0 \le P_a \le P_b \le P_c \le 180$, and $0 \le m \le n \le 100$. As an example, $0 < P_a < P_b < P_c < 180$, and $0 < m < n \le 100$. For example, $P_a=40$, $P_b=80$, $P_c=120$, $0<m<n$, and $n=100$. In some examples, $S_1$ and $S_2$ are equal to each other. In certain examples, $S_1$ and $S_2$ are not equal to each other.

According to some embodiments, the curve 500 is used by the voltage generator 340 and the driver 350 to affect (e.g., to control), in response to the signal 342, the load current 362 that flows through the one or more LEDs 360. For example, the curve 500 is designed by taking into account the compatibility of the TRIAC dimmer 310 and/or the reaction of human eyes to brightness changes of the one or more LEDs 360.

As discussed above and further emphasized here, FIG. 3 is merely an example, which should not unduly limit the scope of the claims. One of ordinary skill in the art would recognize many variations, alternatives, and modifications. In certain embodiments, the phase detector 330 receives the voltage 382 (e.g., $V_s$) and generates the signal 342 (e.g., a digital signal) that represents the total number of counts made within each half cycle of the AC input voltage 314 (e.g., each cycle of the voltage 382) when the AC input voltage 314 (e.g., $V_{Line}$) is not clipped by the TRIAC dimmer 310. As an example, the total number of counts is a binary number. For example, the voltage generator 340 receives the signal 342 (e.g., a digital signal) that represents the total number of counts, and determines, according to Equation 6, the phase change, within which, for each half cycle, the AC input voltage 314 (e.g., $V_{Line}$) is not clipped by the TRIAC dimmer 310. As an example, the voltage generator 340 uses the phase change to generate the reference voltage 384 (e.g., $V_{REF}$). In some examples, the voltage generator 340 and the driver 350 use the curve 500 to affect (e.g., to control), in response to the signal 342, the load current 362 that flows through the one or more LEDs 360.

In some embodiments, the phase detector 330 receives the voltage 382 (e.g., $V_s$) and generates the signal 342 (e.g., a digital signal) that represents the time duration, during which, for each half cycle, the AC input voltage 314 (e.g., $V_{Line}$) is not clipped by the TRIAC dimmer 310. For example, the voltage generator 340 receives the signal 342 (e.g., a digital signal) that represents the time duration, and determines, according to Equation 5, the phase change, within which, for each half cycle, the AC input voltage 314 (e.g., $V_{Line}$) is not clipped by the TRIAC dimmer 310. As an example, the voltage generator 340 uses the phase change to generate the reference voltage 384 (e.g., $V_{REF}$). In some examples, the voltage generator 340 and the driver 350 use the curve 500 to affect (e.g., to control), in response to the signal 342, the load current 362 that flows through the one or more LEDs 360.

Also, as discussed above and further emphasized here, FIG. 3, FIG. 4A, FIG. 4B and FIG. 5 are merely examples, which should not unduly limit the scope of the claims. One of ordinary skill in the art would recognize many variations, alternatives, and modifications. In certain embodiments, the phase detector 330 receives the voltage 382 (e.g., $V_s$) and generates the signal 342 (e.g., a digital signal) that represents the phase change, within which, for each half cycle, the AC input voltage 314 (e.g., $V_{Line}$) is clipped by the TRIAC dimmer 310. For example, the curve 500 is also modified so that the voltage generator 340 and the driver 350 use the curve 500 to affect (e.g., to control), in response to the signal 342, the load current 362 that flows through the one or more LEDs 360. In some embodiments, the phase detector 330 receives the voltage 382 (e.g., $V_s$) and generates the signal 342 (e.g., a digital signal) that represents the total number of counts made within each half cycle of the AC input voltage 314 (e.g., each cycle of the voltage 382) when the AC input voltage 314 (e.g., $V_{Line}$) is clipped by the TRIAC dimmer 310. For example, the curve 500 is also modified so that the voltage generator 340 and the driver 350 use the curve 500 to affect (e.g., to control), in response to the signal 342, the load current 362 that flows through the one or more LEDs 360. In certain embodiments, the phase detector 330 receives the voltage 382 (e.g., $V_s$) and generates the signal 342 (e.g., a digital signal) that represents the time duration, during which, for each half cycle, the AC input voltage 314 (e.g., $V_{Line}$) is clipped by the TRIAC dimmer 310. For example, the curve 500 is also modified so that the voltage generator 340 and the driver 350 use the curve 500 to affect (e.g., to control), in response to the signal 342, the load current 362 that flows through the one or more LEDs 360.

According to some embodiments, with the modified curve 500, if the phase change is equal to or larger than 0 degree but smaller than $P_a$ degrees, the relative magnitude of the load current 362 is equal to n percent. In certain examples, if the phase change is larger than $P_a$ degrees but smaller than $P_b$ degrees, the relative magnitude of the load current 362 decreases with the phase change linearly at a slope $S_1$ from n percent to m percent. For example, if the phase change is equal to $P_a$ degrees, the relative magnitude of the load current 362 is equal to n percent. As an example, if the phase change is equal to $P_b$ degrees, the relative magnitude of the load current 362 is equal to m percent. In some examples, if the phase change is larger than $P_b$ degrees but smaller than $P_c$ degrees, the relative magnitude of the load current 362 decreases with the phase change linearly at a slope $S_2$ from m percent to 0 percent. For example, if the phase change is equal to $P_b$ degrees, the relative magnitude of the load current 362 is equal to m percent. As an example, if the phase change is equal to $P_c$ degrees, the relative magnitude of the load current 362 is equal to 0 percent. In certain examples, if the phase change is larger than $P_c$ degrees but smaller than or equal to 180 degrees, the relative magnitude of the load current 362 is equal to 0 percent. In certain embodiments, $0 \leq P_a \leq P_b \leq P_c \leq 180$, and $0 \leq m \leq n \leq 100$. As an example, $0 < P_a < P_b < P_c < 180$, and $0 < m < n \leq 100$. For example, $P_a = 40$, $P_b = 80$, $P_c = 120$, $0 < m < n$, and $n = 100$. In some examples, $S_1$ and $S_2$ are equal to each other. In certain examples, $S_1$ and $S_2$ are not equal to each other.

Moreover, as discussed above and further emphasized here, FIG. 5 is merely an example, which should not unduly limit the scope of the claims. One of ordinary skill in the art would recognize many variations, alternatives, and modifications. In certain embodiments, the curve 500 represents the relative magnitude of the load voltage as a function of the phase change. For example, the load voltage is the voltage applied across the one or more LEDs 360. As an example, the load voltage corresponds to the load current 362 that flows through the one or more LEDs 360.

Figure 6:
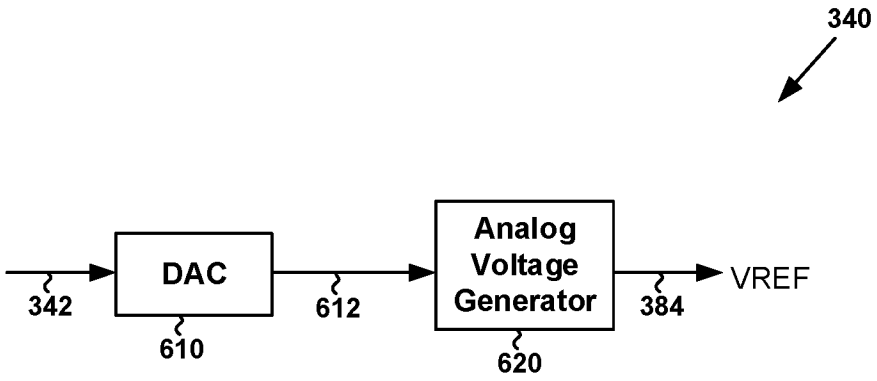
FIG. 6 is a simplified diagram of the voltage generator of the lighting system as shown in FIG. 3 according to some embodiments of the present invention.

FIG. 6 is a simplified diagram of the voltage generator 340 of the lighting system 300 as shown in FIG. 3 according to some embodiments of the present invention. This diagram is merely an example, which should not unduly limit the scope of the claims. One of ordinary skill in the art would recognize many variations, alternatives, and modifications. The voltage generator 340 includes a digital-to-analog converter (DAC) 610 and an analog voltage generator 620. In some embodiments, the signal 342 is a digital signal that represents phase information of the voltage 382 (e.g., $V_s$), and the digital-to-analog converter (DAC) 610 receives the digital signal 342, converts the digital signal 342 to an analog signal 612 that also represents phase information of the voltage 382 (e.g., $V_s$), and outputs the analog signal 612 to the analog voltage generator 620. In certain examples, the analog voltage generator 620 receives the analog signal 612 and generates the reference voltage 384 (e.g., $V_{REF}$), which is an analog voltage. As an example, the reference voltage 384 (e.g., $V_{REF}$) is a DC voltage and is received by the driver 350. In some examples, the voltage generator 340 and the driver 350 use the curve 500 as shown in FIG. 5 to affect (e.g., to control) the load current 362 that flows through the one or more LEDs 360.

Figure 7:
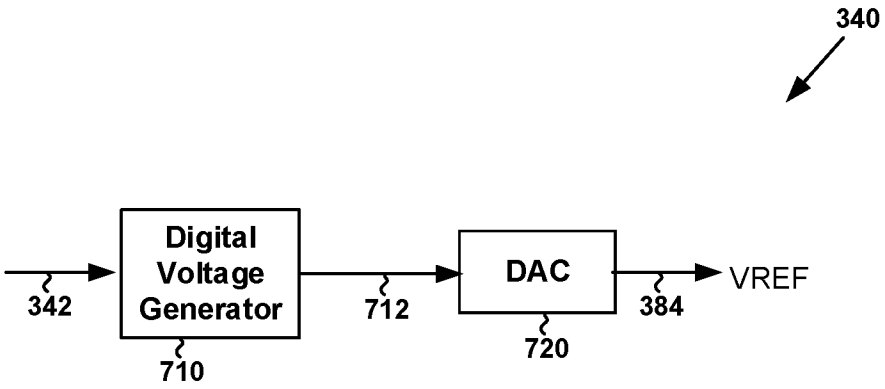
FIG. 7 is a simplified diagram of the voltage generator of the lighting system as shown in FIG. 3 according to certain embodiments of the present invention.

FIG. 7 is a simplified diagram of the voltage generator 340 of the lighting system 300 as shown in FIG. 3 according to certain embodiments of the present invention. This diagram is merely an example, which should not unduly limit the scope of the claims. One of ordinary skill in the art would recognize many variations, alternatives, and modifications. The voltage generator 340 includes a digital voltage generator 710 and a digital-to-analog converter (DAC) 720. In some embodiments, the signal 342 is a digital signal that represents phase information of the voltage 382 (e.g., $V_s$), and the digital voltage generator 710 receives the digital signal 342, generates a digital voltage 712 based at least in part on the digital signal 342, and outputs the digital voltage 712 to the digital-to-analog converter (DAC) 720. In certain examples, the digital-to-analog converter (DAC) 720 receives the digital voltage 712 and converts the digital voltage 712 to the reference voltage 384 (e.g., $V_{REF}$), which is an analog voltage. As an example, the reference voltage 384 (e.g., $V_{REF}$) is a DC voltage and is received by the driver 350. In some examples, the voltage generator 340 and the driver 350 use the curve 500 as shown in FIG. 5 to affect (e.g., to control) the load current 362 that flows through the one or more LEDs 360.

Figure 8:
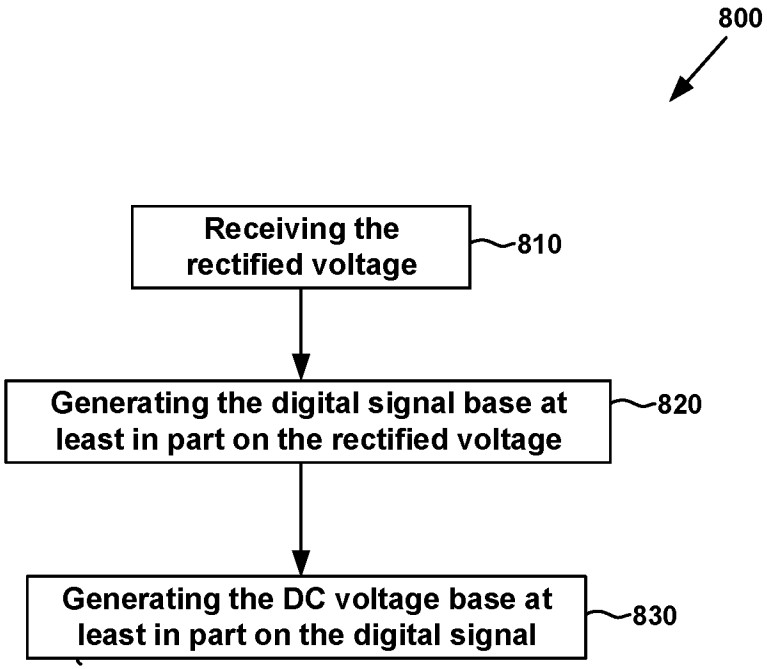
FIG. 8 is a simplified diagram of a method for generating the reference voltage by the lighting system as shown in FIG. 3 according to some embodiments of the present invention.

FIG. 8 is a simplified diagram of a method for generating the reference voltage 384 (e.g., $V_{REF}$) by the lighting system 300 as shown in FIG. 3 according to some embodiments of the present invention. This diagram is merely an example, which should not unduly limit the scope of the claims. One of ordinary skill in the art would recognize many variations, alternatives, and modifications. The method 800 includes a process 810 for receiving the rectified voltage 382, a process 820 for generating the digital signal 342 based at least in part on the rectified voltage 382, and a process 830 for generating the DC voltage 384 based at least in part on the digital signal 342, according to certain embodiments.

In certain embodiments, at the process 810, the rectified voltage 382 (e.g., $V_s$) is received by the phase detector 330. For example, the voltage divider including the resistors 370 and 372 receives the rectified output voltage 322 and, in response, generates the rectified voltage 382 (e.g., $V_s$) according to Equation 4.

In some embodiments, at the process 820, the phase detector 330 generates, based at least in part on the rectified voltage 382, the digital signal 342 that represents phase information of the rectified voltage 382 (e.g., $V_s$). For example, the digital signal 342 represents the phase change, within which, for each half cycle, the AC input voltage 314 (e.g., $V_{Line}$) is not clipped by the TRIAC dimmer 310. As an example, the digital signal 342 represents the total number of counts made within each half cycle of the AC input voltage 314 (e.g., each cycle of the voltage 382) when the AC input voltage 314 (e.g., $V_{Line}$) is not clipped by the TRIAC dimmer 310. For example, the digital signal 342 represents the time duration, during which, for each half cycle, the AC input voltage 314 (e.g., $V_{Line}$) is not clipped by the TRIAC dimmer 310.

In certain embodiments, at the process 830, the voltage generator 340 receives the digital signal 342 and generates the DC voltage 384 (e.g., $V_{REF}$) based at least in part on the digital signal 342. For example, the reference voltage 384 is received by the driver 350, which in response affects (e.g., controls) the load current 362 that flows through the one or more LEDs 360. As an example, the voltage generator 340 and the driver 350 use the curve 500 as shown in FIG. 5 to affect (e.g., to control), in response to the digital signal 342, the load current 362 that flows through the one or more LEDs 360.

According to some embodiments, the process 830 is performed by the voltage generator 340 as shown in FIG. 6. For example, the digital signal 342 is converted to the analog signal 612 that also represents phase information of the voltage 382 (e.g., $V_s$), and the analog signal 612 is used to generate the reference voltage 384 (e.g., $V_{REF}$), which is an analog voltage. As an example, the reference voltage 384 (e.g., $V_{REF}$) is used to affect (e.g., to control) the load current 362 that flows through the one or more LEDs 360 according to the curve 500 as shown in FIG. 5.

According to certain embodiments, the process 830 is performed by the voltage generator 340 as shown in FIG. 7. For example, the digital signal 342 is converted to the digital voltage 712, and the digital voltage 712 is used to generate the reference voltage 384 (e.g., $V_{REF}$), which is an analog voltage. As an example, the reference voltage 384 (e.g., $V_{REF}$) is used to affect (e.g., to control) the load current 362 that flows through the one or more LEDs 360 according to the curve 500 as shown in FIG. 5.

In some embodiments, the lighting system 300 does not use an RC filtering circuit that includes a resistor and a capacitor, and the lighting system 300 does not need a large capacitor to generate a DC voltage; therefore, the size and/or the cost of the IC chip is reduced. In certain embodiments, the curve 500 as shown in FIG. 5 is predetermined. In some examples, during the predetermination process, the curve 500 can be adjusted, so the one or more LEDs 360 can be driven in a flexible manner. As an example, different types of LEDs have different compatibilities with the TRIAC dimmer 310, so the curve 500 also depends on the types of LEDs. For example, the reaction of human eyes to brightness changes of the one or more LEDs 360 depends on the types of LEDs, so the curve 500 also depends on the types of LEDs. In certain examples, different predetermined curves 500 are used by the lighting system 300 without changing the circuit design, so the same circuit can be used to drives different types of the one or more LEDs 360. For example, the lighting system 300 can be adapted to different types of the one or more LEDs 360 by using different predetermined curves 500.

According to some embodiments, a system for voltage conversion to drive one or more light emitting diodes with at least a TRIAC dimmer, the system comprising: a phase detector configured to receive a first rectified voltage generated based at least in part on an AC input voltage processed by at least the TRIAC dimmer, the phase detector being further configured to generate a digital signal representing phase information associated with the first rectified voltage; a voltage generator configured to receive the digital signal and generate a DC voltage based at least in part on the digital signal; and a driver configured to receive the DC voltage and affect, based at least in part on the DC voltage, a current flowing through the one or more light emitting diodes; wherein the current changes with the phase information according to a predetermined function. For example, the system is implemented according to at least FIG. 3.

In some examples, the phase information includes a phase change, within which, for each cycle of the first rectified voltage, the AC input voltage is not clipped by the TRIAC dimmer. In certain examples, the phase information includes a time duration, within which, for each cycle of the first rectified voltage, the AC input voltage is not clipped by the TRIAC dimmer. In some examples, the phase information includes, for each cycle of the first rectified voltage, a total number of counts made by the phase detector when the AC input voltage is not clipped by the TRIAC dimmer.

In certain examples, the phase information includes a phase change, within which, for each cycle of the first rectified voltage, the AC input voltage is clipped by the TRIAC dimmer. In some examples, the phase information includes a time duration, within which, for each cycle of the first rectified voltage, the AC input voltage is clipped by the TRIAC dimmer. In certain examples, the phase information includes, for each cycle of the first rectified voltage, a total number of counts made by the phase detector when the AC input voltage is clipped by the TRIAC dimmer.

In some examples, the voltage generator includes a digital-to-analog converter and an analog voltage generator; wherein: the digital-to-analog converter is configured to receive the digital signal and convert the digital signal to an analog signal also representing the phase information associated with the first rectified voltage; and the analog voltage generator configured to receive the analog signal and generate the DC voltage based at least in part on the analog signal. In certain examples, the voltage generator includes a digital voltage generator and a digital-to-analog converter; wherein: the digital voltage generator is configured to receive the digital signal and generate a digital output voltage based at least in part on the digital signal; and the digital-to-analog converter is configured to receive the digital output voltage and convert the digital output voltage to the DC voltage.

In some examples, the system further includes: the TRIAC dimmer configured to receive the AC input voltage and generate a processed voltage by clipping at least a part of the AC input voltage; a rectifier configured to receive the processed voltage and generate a second rectified voltage; and a voltage divider configured to receive the second rectified voltage and generate the first rectified voltage.

According to some embodiments, a method for voltage conversion to drive one or more light emitting diodes with at least a TRIAC dimmer, the method comprising: receiving a first rectified voltage generated based at least in part on an AC input voltage processed by at least the TRIAC dimmer; processing at least information associated with the first rectified voltage; generating a digital signal representing phase information associated with the first rectified voltage; receiving the digital signal; generating a DC voltage based at least in part on the digital signal; receiving the DC voltage; and affecting, based at least in part on the DC voltage, a current flowing through the one or more light emitting diodes; wherein the current changes with the phase information according to a predetermined function. For example, the method is implemented according to at least FIG. 8.

In some examples, the phase information includes a phase change, within which, for each cycle of the first rectified voltage, the AC input voltage is not clipped by the TRIAC dimmer. In certain examples, the phase information includes a time duration, within which, for each cycle of the first rectified voltage, the AC input voltage is not clipped by the TRIAC dimmer. In some examples, the phase information includes, for each cycle of the first rectified voltage, a total number of counts made when the AC input voltage is not clipped by the TRIAC dimmer.

In certain examples, the phase information includes a phase change, within which, for each cycle of the first rectified voltage, the AC input voltage is clipped by the TRIAC dimmer. In some examples, the phase information includes a time duration, within which, for each cycle of the first rectified voltage, the AC input voltage is clipped by the TRIAC dimmer. In certain examples, the phase information includes, for each cycle of the first rectified voltage, a total number of counts made when the AC input voltage is clipped by the TRIAC dimmer.

In some examples, the generating a DC voltage based at least in part on the digital signal includes: receiving the digital signal; converting the digital signal to an analog signal also representing the phase information associated with the first rectified voltage; receiving the analog signal; and generating the DC voltage based at least in part on the analog signal. In certain examples, the generating a DC voltage based at least in part on the digital signal includes: receiving the digital signal; generating a digital output voltage based at least in part on the digital signal; receiving the digital output voltage; and converting the digital output voltage to the DC voltage.

In some examples, the method further includes: receiving the AC input voltage; generating a processed voltage by clipping at least a part of the AC input voltage; receiving the processed voltage; processing at least information associated with the processed voltage; generating a second rectified voltage based at least in part on the processed voltage; receiving the second rectified voltage; and generating the first rectified voltage based at least in part on the second rectified voltage.

For example, some or all components of various embodiments of the present invention each are, individually and/or in combination with at least another component, implemented using one or more software components, one or more hardware components, and/or one or more combinations of software and hardware components. In another example, some or all components of various embodiments of the present invention each are, individually and/or in combination with at least another component, implemented in one or more circuits, such as one or more analog circuits and/or one or more digital circuits. In yet another example, various embodiments and/or examples of the present invention can be combined.

Although specific embodiments of the present invention have been described, it will be understood by those of skill in the art that there are other embodiments that are equivalent to the described embodiments. Accordingly, it is to be understood that the invention is not to be limited by the specific illustrated embodiments.

What is claimed is:

1. A system for voltage conversion to drive one or more light emitting diodes with at least a TRIAC dimmer, the system comprising:

a phase detector configured to receive a first rectified voltage generated based at least in part on an AC input voltage processed by at least the TRIAC dimmer, the phase detector being further configured to generate a digital signal representing phase information associated with the first rectified voltage; and a signal generator configured to receive the digital signal and generate a voltage signal, the signal generator further configured to affect, based at least in part on the voltage signal, a current flowing through the one or more light emitting diodes;

wherein:

the phase information includes a phase change;

a relative magnitude of the current is represented in percentage, the relative magnitude being one hundred percent when each of the one or more light emitting diodes is turned on and at a maximum brightness;

if the phase change is less than a first degree, a relative magnitude of the current is equal to zero percent;

if the phase change is greater than the first degree and smaller than a second degree, the relative magnitude of the current increases linearly with the phase change at a first slope from zero percent to a first percent, the second degree being greater than the first degree, the first percent being greater than zero percent;

if the phase change is greater than the second degree and smaller than a third degree, the relative magnitude of the current increases linearly with the phase change at a second slope from the first percent to a second percent, the third degree being greater than the second degree, the second percent being greater than the first percent;

if the phase change is greater than the third degree and smaller than a fourth degree, the relative magnitude of the current changes is equal to the second percent, the fourth degree being greater than the third degree; and the first slope is different from the second slope.

2. The system of claim 1 wherein the phase information includes a phase change, within which, for each cycle of the first rectified voltage, the AC input voltage is not clipped by the TRIAC dimmer.

3. The system of claim 1 wherein the phase information includes a time duration, within which, for each cycle of the first rectified voltage, the AC input voltage is not clipped by the TRIAC dimmer.

4. The system of claim 1 wherein the phase information includes, for each cycle of the first rectified voltage, a total number of counts made by the phase detector when the AC input voltage is not clipped by the TRIAC dimmer.

5. The system of claim 1 wherein the phase information includes a phase change, within which, for each cycle of the first rectified voltage, the AC input voltage is clipped by the TRIAC dimmer.

6. The system of claim 1 wherein the phase information includes a time duration, within which, for each cycle of the first rectified voltage, the AC input voltage is clipped by the TRIAC dimmer.

7. The system of claim 1 wherein the phase information includes, for each cycle of the first rectified voltage, a total number of counts made by the phase detector when the AC input voltage is clipped by the TRIAC dimmer.

8. The system of claim 1 wherein:

the signal generator includes a digital-to-analog converter and an analog voltage generator;

wherein:

the digital-to-analog converter is configured to receive the digital signal and convert the digital signal to an analog signal also representing the phase information associated with the first rectified voltage; and the analog voltage generator configured to receive the analog signal and generate the voltage signal based at least in part on the analog signal.

9. The system of claim 1 wherein:

the signal generator includes a digital voltage generator and a digital-to-analog converter;

wherein:

the digital voltage generator is configured to receive the digital signal and generate a digital output voltage based at least in part on the digital signal; and the digital-to-analog converter is configured to receive the digital output voltage and convert the digital output voltage to the voltage signal.

10. The system of claim 1 wherein the TRIAC dimmer is configured to receive the AC input voltage and generate a processed voltage by clipping at least a part of the AC input voltage;

the system further comprising:

a rectifier configured to receive the processed voltage and generate a second rectified voltage; and a voltage divider configured to receive the second rectified voltage and generate the first rectified voltage.

11. A method for voltage conversion to drive one or more light emitting diodes with at least a TRIAC dimmer, the method comprising:

receiving a first rectified voltage generated based at least in part on an AC input voltage processed by at least the TRIAC dimmer;

processing at least information associated with the first rectified voltage;

generating a digital signal representing phase information associated with the first rectified voltage;

receiving the digital signal;

generating a voltage signal based at least in part on the digital signal; and affecting, based at least in part on the voltage signal, a current flowing through the one or more light emitting diodes;

wherein:

the phase information includes a phase change;

a relative magnitude of the current is represented in percentage, the relative magnitude being one hundred percent when each of the one or more light emitting diodes is turned on and at a maximum brightness;

if the phase change is less than a first degree, the relative magnitude of the current is equal to zero percent;

if the phase change is greater than the first degree and smaller than a second degree, the relative magnitude of the current increases linearly with the phase change at a first slope from zero percent to a first percent, the second degree being greater than the first degree, the first percent being greater than zero percent;

if the phase change is greater than the second degree and smaller than a third degree, the relative magnitude of the current increases linearly with the phase change at a second slope from the first percent to a second percent, the third degree being greater than the second degree, the second percent being greater than the first percent;

if the phase change is greater than the third degree and smaller than a fourth degree, the relative magnitude of the current changes is equal to the second percent, the fourth degree being greater than the third degree; and the first slope is different from the second slope.

12. The method of claim 11 wherein the phase information includes a phase change, within which, for each cycle of the first rectified voltage, the AC input voltage is not clipped by the TRIAC dimmer.

13. The method of claim 11 wherein the phase information includes a time duration, within which, for each cycle of the first rectified voltage, the AC input voltage is not clipped by the TRIAC dimmer.

14. The method of claim 11 wherein the phase information includes, for each cycle of the first rectified voltage, a total number of counts made when the AC input voltage is not clipped by the TRIAC dimmer.

15. The method of claim 11 wherein the phase information includes a phase change, within which, for each cycle of the first rectified voltage, the AC input voltage is clipped by the TRIAC dimmer.

16. The method of claim 11 wherein the phase information includes a time duration, within which, for each cycle of the first rectified voltage, the AC input voltage is clipped by the TRIAC dimmer.

17. The method of claim 11 wherein the phase information includes, for each cycle of the first rectified voltage, a total number of counts made when the AC input voltage is clipped by the TRIAC dimmer.

18. The method of claim 11 wherein the generating a voltage signal based at least in part on the digital signal includes:

converting the digital signal to an analog signal representing the phase information associated with the first rectified voltage;

receiving the analog signal; and generating the voltage signal based at least in part on the analog signal.

19. The method of claim 11 wherein the generating a voltage signal based at least in part on the digital signal includes:

generating a digital output voltage based at least in part on the digital signal;

receiving the digital output voltage; and converting the digital output voltage to the voltage signal.

20. The method of claim 11, and further comprising:

receiving the AC input voltage;

generating a processed voltage by clipping at least a part of the AC input voltage;

receiving the processed voltage;

processing at least information associated with the processed voltage;

generating a second rectified voltage based at least in part on the processed voltage;

receiving the second rectified voltage; and generating the first rectified voltage based at least in part on the second rectified voltage.

* * * * *